US010249227B2

(12) United States Patent
Shi

(10) Patent No.: US 10,249,227 B2
(45) Date of Patent: Apr. 2, 2019

(54) SCANNING DRIVING CIRCUITS HAVING CHARGE SHARING AND DISPLAY PANELS

(71) Applicant: Shenzhen China Star Optoelectronics Technology Co., Ltd., Shenzhen, Guangdong (CN)

(72) Inventor: Longqiang Shi, Guangdong (CN)

(73) Assignee: Shenzhen China Star Optoelectronics Semiconductor Display Technology Co., Ltd, Shenzhen, Guangdong (CN)

( * ) Notice: Subject to any disclaimer, the term of this patent is extended or adjusted under 35 U.S.C. 154(b) by 156 days.

(21) Appl. No.: 15/520,551

(22) PCT Filed: Apr. 6, 2017

(86) PCT No.: PCT/CN2017/079560
§ 371 (c)(1),
(2) Date: Apr. 20, 2017

(87) PCT Pub. No.: WO2018/161394
PCT Pub. Date: Sep. 13, 2018

(65) Prior Publication Data

US 2018/0301074 A1 Oct. 18, 2018

(30) Foreign Application Priority Data

Mar. 9, 2017 (CN) ..... 2017 1 0138383

(51) Int. Cl.
*G09G 3/20* (2006.01)

(52) U.S. Cl.
CPC ..... *G09G 3/20* (2013.01); *G09G 2310/06* (2013.01); *G09G 2310/08* (2013.01)

(58) Field of Classification Search
None
See application file for complete search history.

(56) References Cited

U.S. PATENT DOCUMENTS

| | | | | |
|---|---|---|---|---|
| 2016/0240158 | A1 | 8/2016 | Xu | |
| 2017/0011699 | A1* | 1/2017 | Wang | G11C 19/28 |
| 2017/0162148 | A1 | 6/2017 | Xiao et al. | |

FOREIGN PATENT DOCUMENTS

| | | | |
|---|---|---|---|
| CN | 102034444 | A | 4/2011 |
| CN | 103093719 | A | 5/2013 |
| CN | 106297629 | A | 1/2017 |
| CN | 106409262 | A | 2/2017 |
| JP | 4367342 | B2 | 11/2009 |

* cited by examiner

*Primary Examiner* — Benjamin C Lee
*Assistant Examiner* — Krishna P Neupane
(74) *Attorney, Agent, or Firm* — Andrew C. Cheng

(57) ABSTRACT

The present disclosure relates to a scanning driving circuit having charge sharing and a display panel. The scanning driving circuit includes: a driving unit is configured to receive a previous scanning signal, a current clock signal and a next scanning signal, and to generate a current scanning signal, a pull-down maintain unit is configured to conduct a pull down process with respect to a pull down controlling signal point of the driving unit, a share unit is configured to receive a first clock signal, a second clock signal, a first voltage signal, and a second voltage signal, and to control an electric potential of a rising edge and a falling edge of the current scanning signal via the first clock signal, the second clock signal, the first voltage signal, and the second voltage signal.

12 Claims, 5 Drawing Sheets

SCANNING DRIVING CIRCUITS HAVING CHARGE SHARING AND DISPLAY PANELS

BACKGROUND OF THE INVENTION

1. Field of the Invention

The present disclosure relates to display technology field, and more particularly to a scanning driving circuit having charge sharing and a display panel.

2. Discussion of the Related Art

The performance of the display images may be greatly influenced by the compensation voltage in the pixel area of the display panels. Therefore, it is important to reduce the compensation voltage with respect to the displays controlled by the scanning driving circuit. FIG. 1 is a schematic view of a conventional scanning driving circuit. According to a wave diagram of the conventional scanning driving circuit shown in FIG. 2, the operating waves of the scanning signals are mainly controlled by the clock signals with respect to different timings. When the clock signal waves have a share function, the scanning driving circuit may generate corresponding scanning signals via inputting the signals with charge share function. Such that the scanning signals may lower down the compensation voltage of the pixel area. However, the conventional clock signals with the charge share function are provided by the driving chip at the system-side. As such, the driving chip may become more complicated, which result in higher costs.

SUMMARY

The present disclosure relates to a scanning driving circuit having charge sharing and a display panel, wherein the scanning driving circuit having charge sharing and the display panel are capable of reducing the compensation voltage, reducing the costs, and enhancing the performance of the display panel In one aspect, a scanning driving circuit having charge sharing, including: a driving unit configured to receive a previous scanning signal, a current clock signal, and a next scanning signal, and to generate a current scanning signal according to the previous scanning signal, the current clock signal and the next scanning signal, a pull-down maintain unit connecting to the driving unit and configured to conduct a pull down process with respect to a pull down controlling signal point of the driving unit, a share unit connecting to the driving unit and the pull-down maintain unit, wherein the share unit is configured to receive a first clock signal, a second clock signal, a first voltage signal, and a second voltage signal, and to control an electric potential of a rising edge and a falling edge of the current scanning signal via the first clock signal, the second clock signal, the first voltage signal, and the second voltage signal, so as to reduce a scanning-driving-circuit compensation voltage.

In another aspect, a display panel, including a scanning driving circuit having charge sharing, wherein the scanning driving circuit includes: a driving unit configured to receive a previous scanning signal, a current clock signal, and a next scanning signal, and to generate a current scanning signal according to the previous scanning single, the current clock signal and the next scanning signal, a pull-down maintain unit connecting to the driving unit and configured to conduct a pull down process with respect to a pull down controlling signal point of the driving unit, a share unit connecting to the driving unit and the pull-down maintain unit, wherein the share unit is configured to receive a first clock signal, a second clock signal, a first voltage signal, and a second voltage signal, and to control an electric potential of a rising edge and a falling edge of the current scanning signal via the first clock signal, the second clock signal, the first voltage signal, and the second voltage signal, so as to reduce a scanning-driving-circuit compensation voltage.

In the view of the above, the scanning driving circuit of the present disclosure generates the current scanning signal via the driving unit and the pull-down maintain unit. The scanning driving circuit is configured to control the electric potential of the rising edge and the falling edge of the current scanning signal, so as to reduce the scanning-driving-circuit compensation voltage, to lower down the costs, and to enhance the performance of the display panel.

DETAILED DESCRIPTION OF THE EMBODIMENTS

Figure 1:
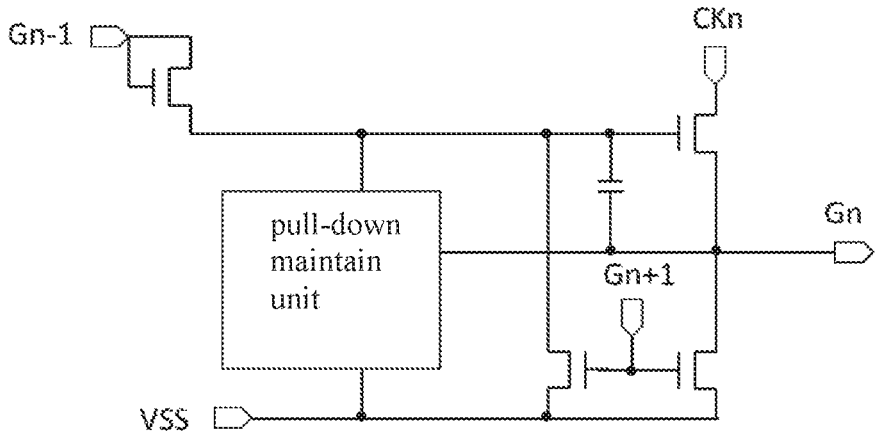
FIG. 1(Prior Art)
FIG. 1 is a circuit diagram of a conventional scanning driving circuit.
Figure 2:
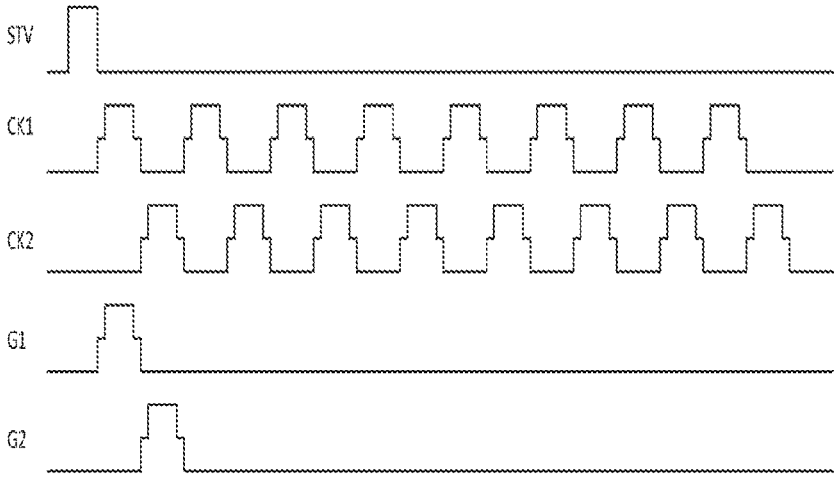
FIG .2(Prior Art)
FIG. 2 is a wave diagram of the conventional scanning driving circuit shown in FIG. 1.
Figure 3:
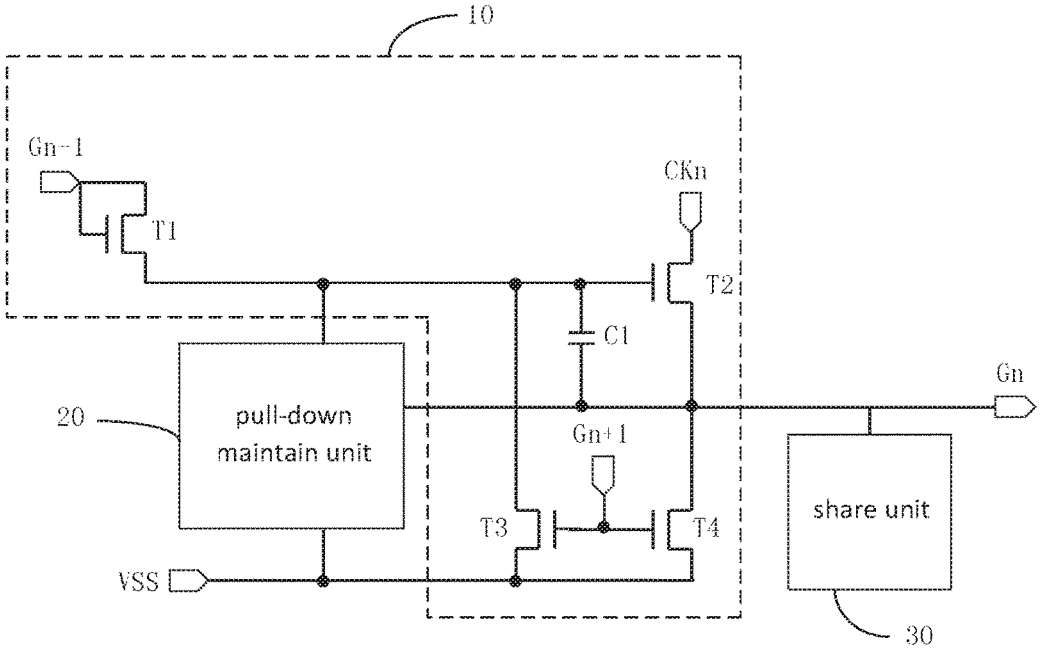
FIG. 3 is a circuit diagram of a scanning driving circuit having charge sharing in accordance with one embodiment of the present disclosure.

FIG. 3 is a circuit diagram of a scanning driving circuit having charge share in accordance with one embodiment of the present disclosure. The scanning driving circuit having charge share 1 includes a driving unit 10 configured to receive a previous scanning signal Gn−1, a current clock signal CKn, and a next scanning signal Gn+1, and to generate a current scanning signal Gn according to the previous scanning signal Gn−1, the current clock signal CKn and the next scanning signal Gn+1, wherein n is an integer.

The scanning driving circuit having charge share 1 further includes a pull-down maintain unit 20 connecting to the driving unit 10. The pull-down maintain unit 20 is configured to conduct a pull down process with respect to a pull down controlling signal point of the driving unit 10.

The scanning driving circuit having charge share 1 further includes a share unit 30 connecting to the driving unit 10 and the pull-down maintain unit 20, wherein the share unit 30 is configured to receive a first clock signal SCK1, a second clock signal SCK2, a first voltage signal VCS1, and a second voltage signal VCS2, and to control an electric potential of a rising edge and a falling edge of the current scanning signal Gn via the first clock signal VCS1, the second clock signal VCS2, the first voltage signal SCK1, and the second voltage signal SCK2, so as to reduce a scanning-driving-circuit compensation voltage.

Specifically, the driving unit 10 includes a first controllable switch T1, a second controllable switch T2, a third controllable switch T3, a fourth controllable switch T4, and a capacitance C1. A control end of the first controllable switch T1 connects to a first end of the first controllable switch T1 and receives the previous scanning signal Gn−1. A second end of the first controllable switch T1 connects to the pull-down maintain unit 20, a control end of the second controllable switch T2, and a first end of the third controllable switch T3. A first end of the second controllable switch T2 receives the current clock signal CKn. A second end of the second controllable switch T2 connects to a first end of a fourth controllable switch T4, the pull-down maintain unit 20, the share unit 30, and an output end of the current scanning signal Gn. A control end of the fourth controllable switch T4 connects to a control end of the third controllable switch T3 and is configured to receive the next scanning signal Gn+1. A second end of the fourth controllable switch T4 connects to a second end of the third controllable switch T3, the pull-down maintain unit 20, and the second end of the fourth controllable switch T4. The second end of the fourth controllable switch T4 is grounded. The capacitance C1 connects between the control end and the second end of the second controllable switch T2.

Figure 4:
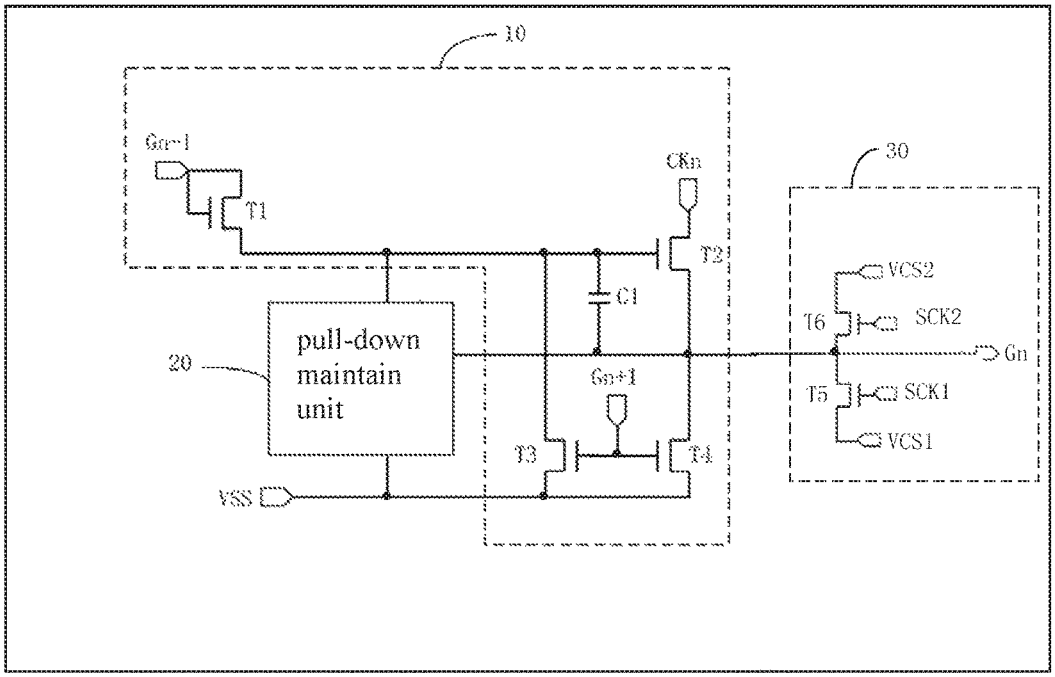
FIG. 4 is a circuit diagram of a scanning driving circuit having charge sharing, shown in FIG. 3, in accordance with a first embodiment of the present disclosure.

FIG. 4 is a circuit diagram of a scanning driving circuit in accordance with a first embodiment of the present disclosure. Wherein the share unit 30 includes a fifth controllable switch T5 and a sixth controllable switch T6. A control end of the fifth controllable switch T5 receives the first clock signal SCK1. A first end of the fifth controllable switch T5 connects to a second end of the sixth controllable switch T6, the second end of the second controllable switch T2, a first end of the fourth controllable switch T4, and the output end of the current scanning signal Gn. A second end of the fifth controllable switch T5 receives the first voltage signal VCS1. A control end of the sixth controllable switch T6 receives the second clock signal SCK2. A first end of the sixth controllable switch T6 receives the second voltage signal VCS2.

In one example, the first controllable switch T1, the second controllable switch T2, the third controllable switch T3, the fourth controllable switch T4, the fifth controllable switch T5, and the sixth controllable switch T6 are N-type thin film transistors (TFTs); a gate, a drain, and a source of the N-type TFT respectively corresponds to the control end, the first end, and the second end of the first controllable switch T1, the second controllable switch T2, the third controllable switch T3, the fourth controllable switch T4, the fifth controllable switch T5, and the sixth controllable switch T6. In another example, the first controllable switch T1, the second controllable switch T2, the third controllable switch T3, the fourth controllable switch T4, the fifth controllable switch T5, and the sixth controllable switch T6 may be another type of switches.

The compensation voltage of a pixel area may be represented by $V_{ft}=(V_{gh}-V_{gl})*C_{gs}/C_{total}$, wherein $V_{ft}$ is the compensation voltage, $V_{gh}$ is a high electric potential of the current scanning signal Gn, $V_{gl}$ is a low electric potential of the current scanning signal Gn, $C_{gs}$ is a parasitic capacitance, and $C_{total}$ is total capacitance of pixels. When the current scanning signal Gn may be divided into a rising edge section and a falling edge section, i.e., charge sharing, the actual compensation voltage $V_{ft}$ equals to $(V_{gh}-V_{gl})*C_{gs}/C_{total}$, as such the compensation voltage $V_{ft}$ may be greatly improved.

Figure 5:
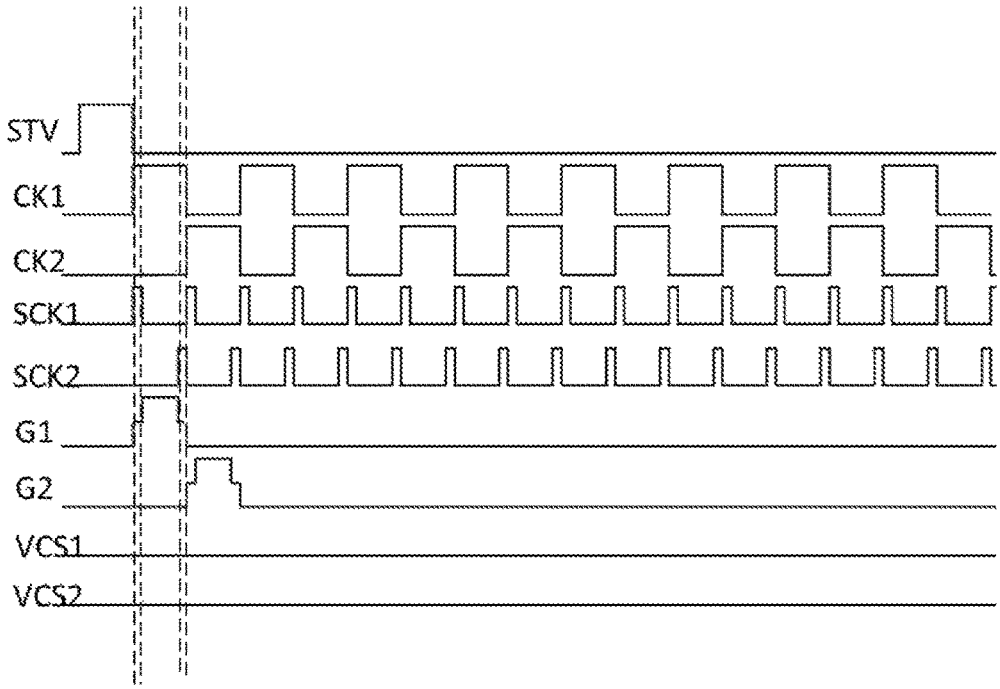
FIG. 5 is a wave diagram of a scanning driving circuit having charge sharing, shown in FIG. 4, upon first and second voltage signals are in a low electric potential state.

The operation principle of the scanning driving circuit resides in that when the first clock signal SCK1 controls the rising edge, the second clock signal SCK2 controls the falling edge. FIG. 5 is a wave diagram of the first voltage signal VCS1 and the second voltage signal VCS2 at the low electric potential state. The scanning driving circuit controls an electric potential of the rising edge and the falling edge of the current scanning signal Gn via the first voltage signal VCS1, and the second voltage signal VCS2.

In one example, when a current scanning signal G1 is the rising edge, if the first clock signal SCK1 is at a high electric potential, the fifth controllable switch T5 turns on, and the low electric potential of the first voltage signal VCS1 input to the current scanning signal G1. As such the high electric potential of the current scanning signal G1 may be reduced to ½ $(V_{gh}-V_{gl})$. If the first clock signal SCK1 is at a low electric potential, the fifth controllable switch T5 turns off, and the high electric potential of the currant loyal the current scanning signal G1 may not be influenced. In another example, when the current scanning signal G1 is the falling edge, if the second clock signal SCK2 is at the high electric potential, the sixth controllable switch T6 turns on, and the low electric potential of the second voltage signal VCS2 input to the current scanning signal G1, As such the high electric potential of the current scanning signal G1 may be reduced to ½ $(V_{gh}-V_{gl})$. If the second clock signal SCK2 is at the low electric level, the sixth controllable switch T6 turns off, and the low electric potential of the current scanning signal G1 may not be influenced.

Figure 6:
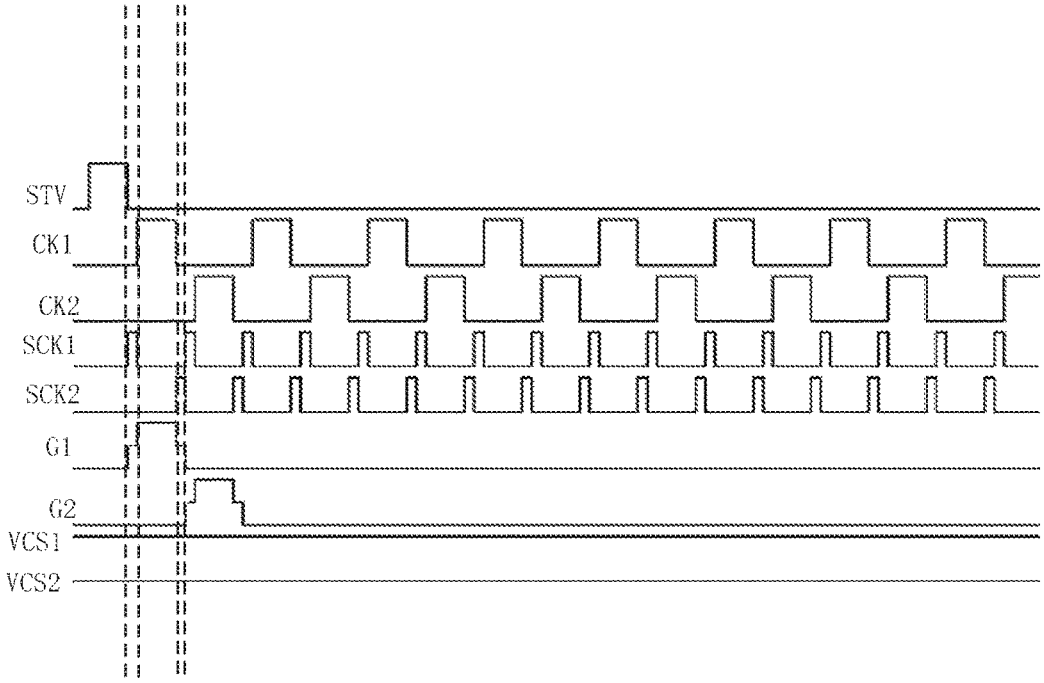
FIG. 6 is a wave diagram of a scanning driving circuit having charge sharing, shown in FIG. 4, upon first and second voltage signals are in a high electric potential state.

FIG. 6 is a wave diagram of the first voltage signal VCS1 and the second voltage signal VCS2 at the high electric potential state. In one example, the scanning driving circuit controls the electric potential of the rising edge and the falling edge via the first voltage signal VCS1, and the second voltage signal VCS2. If the first clock signal SCK1 is at the high electric level, the fifth controllable switch T5 turns on, and the high electric potential of the first voltage signal VCS1 input to the current scanning signal G1. As such the low electric potential of the current scanning signal G1 may be rise to ½ $(V_{gh}-V_{gl})$. If the first clock signal SCK1 is at the low electric level, the fifth controllable switch T5 turns off, the high electric potential of the current scanning signal G1 may not be influenced, and the currant loyal the current scanning signal G1 may turn on normally. In another example, when the current scanning signal G1 is the falling edge, if the second clock signal SCK2 is at the high electric level, the sixth controllable switch T6 turns on, and the high electric potential of the second voltage signal VCS2 input to the current scanning signal G1, As such the low electric potential of the current scanning signal G1 may be rise to ½ $(V_{gh}-V_{gl})$. If the second clock signal SCK2 is at the low electric potential, the sixth controllable switch T6 turns off, and the low electric potential of the current scanning signal G1 may not be influenced.

Figure 7:
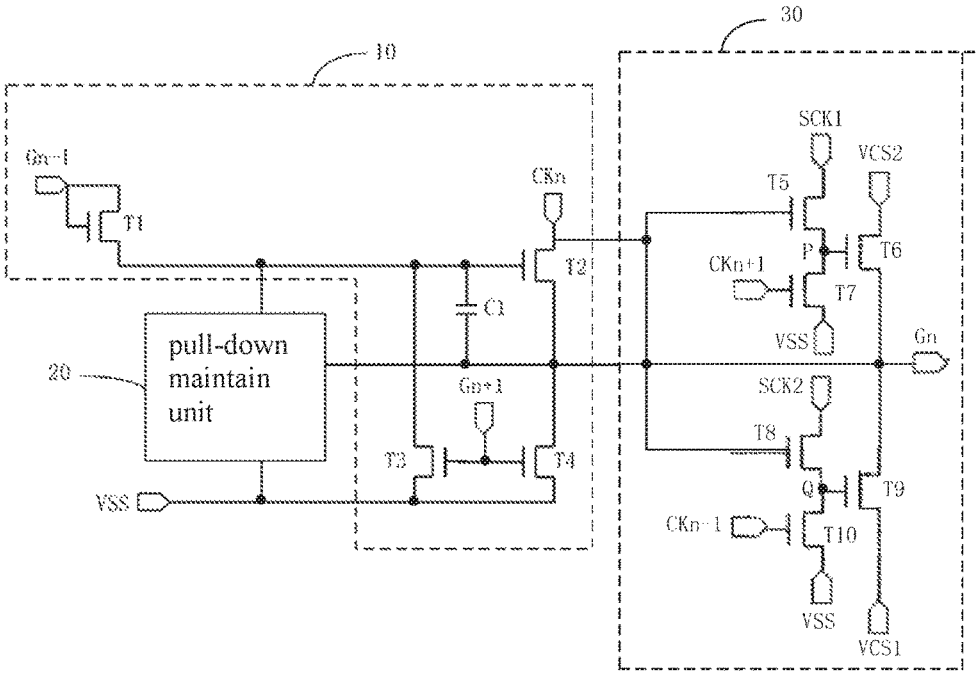
FIG. 7 is a circuit diagram of a scanning driving circuit having charge sharing, shown in FIG. 3, in accordance with a second embodiment of the present disclosure.

FIG. 7 is a circuit diagram of a scanning driving circuit having charge sharing in accordance with a second embodiment of the present disclosure. The difference between the first embodiment and the second embodiment resides in that the share unit includes the fifth controllable switch T5, the sixth controllable switch T6, a seventh controllable switch T7, an eighth controllable switch T8, a ninth controllable switch T9, and a tenth controllable switch T10. Wherein the control end of the fifth controllable switch T5 connects a control end of the eighth controllable switch T8, the first end of the second controllable switch T2, and an output end of the current scanning signal. The first end of the fifth controllable switch T5 receives the first clock signal SCK1. The second end of the fifth controllable switch T5 connects to the control end of the sixth controllable switch T6 and a first end of the seventh controllable switch T7. The first end of the sixth controllable switch T6 receives the second voltage signal VCS2. The second end of the sixth controllable switch T6 connects to a first end of the ninth controllable switch T9 and the output end of the current scanning signal. A control end of the seventh controllable switch T7 receives the next scanning signal Gn+1. A second end of the seventh controllable switch T7 connects to a ground VSS. A first end of the eighth controllable switch T8 receives the second clock signal SCK2. A second end of the eighth controllable switch T8 connects to a control end of the ninth controllable switch T9 and a first end of the tenth controllable switch T10. A second end of the ninth controllable switch T9 receives the first voltage signal VCS1. A control end of the tenth controllable switch T10 receives a previous clock signal CKn−1, and a second end of the tenth controllable switch T10 connects to the ground VSS.

In one example, the first controllable switch T1, the second controllable switch T2, the third controllable switch T3, the fourth controllable switch T4, the fifth controllable switch T5, the sixth controllable switch T6, the seventh controllable switch T7, the eighth controllable switch T8, the ninth controllable switch T9, and the tenth controllable switch T10 are N-type TFTs. A gate, a drain, and a source of the N-type TFT respectively corresponds to the control end, the first end, and the second end of the first controllable switch T1, the second controllable switch T2, the third controllable switch T3, the fourth controllable switch T4, the fifth controllable switch T5, the sixth controllable switch T6, the seventh controllable switch T7, the eighth controllable switch T8, the ninth controllable switch Y9, and the tenth controllable switch T10. In another example, the first controllable switch T1, the second controllable switch T2, the third controllable switch T3, the fourth controllable switch T4, the fifth controllable switch T5, the sixth controllable switch T6, the seventh controllable switch T7, the eighth controllable switch T8, the ninth controllable switch T9, and the tenth controllable switch T10 may be another type of switches.

Figure 8:
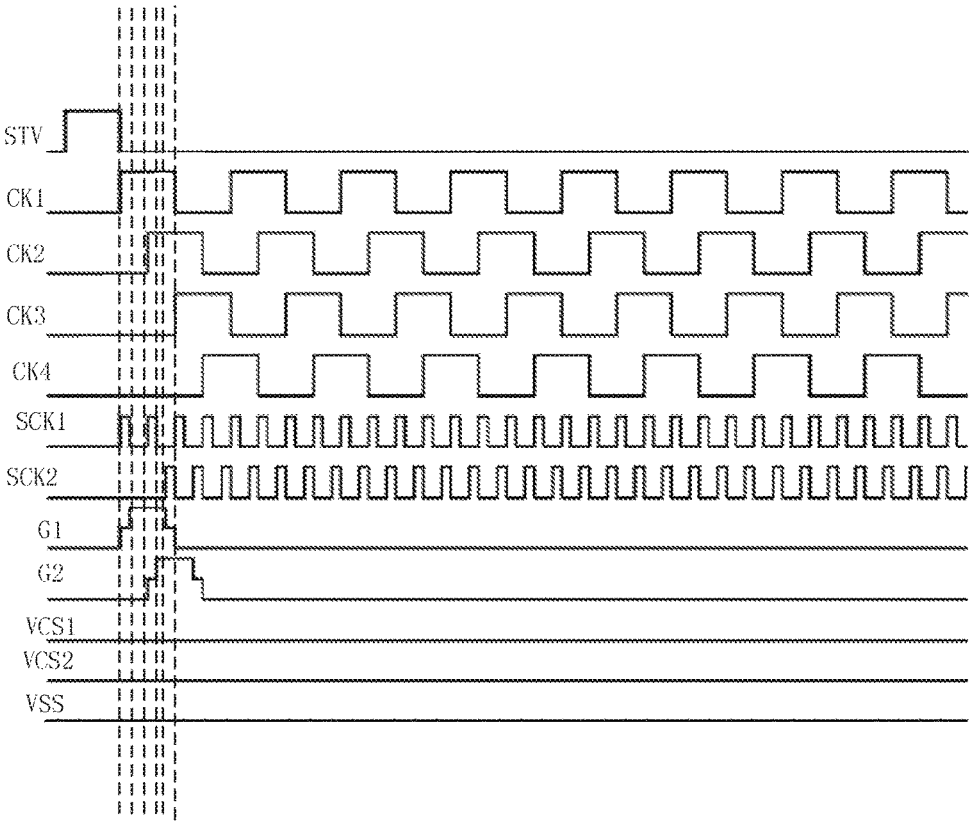
FIG. 8 is a wave diagram of the scanning driving circuit shown in FIG. 7.

FIG. 8 is a wave diagram of the scanning driving circuit in accordance with one example of the present disclosure. Wherein the first voltage signal VCS1 and the second voltage signal VCS2 are in the low electric potential. Taking a current scanning signal G1 as an example. The first clock signal SCK1 controls the rising edge of the current scanning signal G1, and the second clock signal SCK2 controls the falling edge of the current scanning signal G1. A current clock signal CK1 controls the current scanning signal G1. The next clock signal CKn+1 is CK2, and the previous clock signal CKn−1 is CK4.

When the current clock signal CK1 rise, the current scanning signal G1 is at the high electric potential, and the fifth controllable switch T5 turns on. If the first clock signal SCK1 is at the high electric potential, due to the next clock signal CK2 is at the low electric potential, the seventh controllable switch turns off, P is at the high electric potential, and the sixth controllable switch T6 turns on. Therefore, the low electric potential of the second voltage signal VCS2 input to the current scanning signal G1. As such the high electric potential of the current scanning signal G1 is reduced to ½ ($V_{gh}$−$V_{gl}$). If the first clock signal SCK1 is at the low electric potential, the sixth controllable switch T6 turns off, the high electric potential of the current scanning signal G1 may not be influenced.

When the next clock signal CK2 is at the high electric potential, the first clock signal SCK1 is at the high electric potential. Due to the first clock signal SCK1 controls the rising edge of the current clock signal CK1, the current clock signal CK1 maintain to be at the high electric potential. If no treatment is conducted, the current scanning signal G1 may be reduced to ½ ($V_{gh}$−$V_{gl}$). When the next clock signal CK2 is at the high electric potential, the seventh controllable switch T7 turns on, and the low electric potential of grounded signal VSS is inputted. The electric potential of P may be reduced to the low electric potential. The sixth controllable switch T6 turns off, as such the high electric potential of the current scanning signal G1 may not be influenced.

When the second clock signal SCK2 is at the high electric potential, due to the current clock signal CK1 is at the high electric potential, the eighth controllable switch T8 turns on, and the second clock signal SCK2 is at the high electric potential. Due to the previous clock signal CK4 is at the low electric potential, the tenth controllable switch T10 turns off, Q is at the high electric potential, the ninth controllable switch T9 turns on. The low electric potential of the first voltage signal VCS1 input to the current scanning signal G1. The high electric potential of the current scanning signal G1 is reduced to ½ ($V_{gh}$−$V_{gl}$). When the next clock signal CK2 is at the low electric potential, the ninth controllable switch T9 turns off, as such the low electric potential of the current scanning signal G1 may not be influenced.

Figure 9:
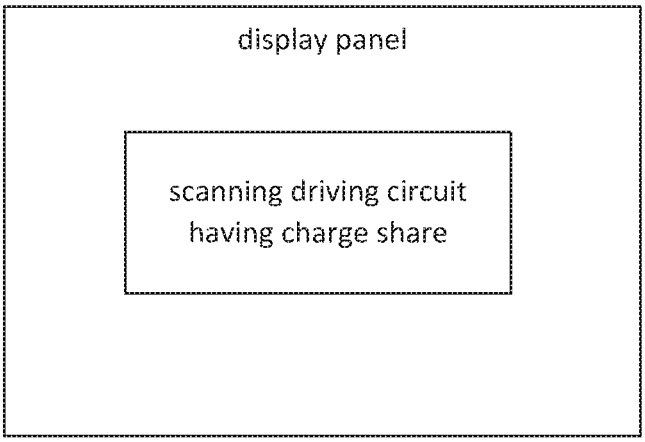
FIG. 9 is a schematic view of a display panel in accordance with one embodiment of the present disclosure.

FIG. 9 is a schematic view of a display panel in accordance with one embodiment of the present disclosure. The display panel 2 includes the scanning driving circuit having charge sharing 1. The other elements and functions of the display panel 2 are same as the conventional display panels, thus the content may not be described again.

The scanning driving circuit generates the current scanning signal via the driving unit and the pull-down maintain unit. The scanning driving circuit is configured to control the electric potential of the rising edge and the falling edge of the current scanning signal, so as to reduce the scanning-driving-circuit compensation voltage, to lower down the costs, and to enhance the performance of the display panel.

The above description is only the embodiments in the present disclosure, the claim is not limited to the description thereby. The equivalent structure or changing of the process of the content of the description and the figures, or to implement to other technical field directly or indirectly should be included in the claim.

What is claimed is:

1. A scanning driving circuit having charge sharing, comprising:

a driving unit configured to receive a previous scanning signal Gn−1, a current clock signal Ckn, and a next scanning signal Gn+1, and to generate a current scanning signal Gn according to the previous scanning signal, the current clock signal and the next scanning signal, wherein n is an integer;

a pull-down maintain unit connecting to the driving unit and configured to conduct a pull down process with respect to a pull down controlling signal point of the driving unit;

a share unit connecting to the driving unit and the pull-down maintain unit, wherein the share unit is configured to receives first clock signal, a second clock signal, a first voltage signal, and a second voltage signal, and to control an electric potential of a rising edge and a falling edge of the current scanning signal via the first clock signal, the second clock signal, the first voltage signal, and the second voltage signal, so as to reduce a scanning-driving-circuit compensation voltage.

2. The scanning driving circuit having charge sharing according to claim 1, wherein the driving unit comprises:

a first controllable switch, a second controllable switch, a third controllable switch, a fourth controllable switch, and a capacitance; a control end of the first controllable switch connects to a first end of the first controllable switch and receive the previous scanning signal, a second end of the first controllable switch connects to the pull-down maintain unit, a control controllable switch of the second controllable switch, and a first end of the third controllable switch; a first end of the second controllable switch receives the current clock signal; a second end of the second controllable switch connects to a first end of a fourth controllable switch, the pull-down maintain unit, the share unit, and an output end of the current scanning signal; a control end of the fourth controllable switch connects to a control end of the third controllable switch and is configured to receive the next scanning signal; a second end of the fourth controllable switch connects to a second end of the third controllable switch, the pull-down maintain unit, and the second end of the fourth controllable switch is grounded; the capacitance connects between the control end and the second end of the second controllable switch.

3. The scanning driving circuit having charge sharing according to claim 2, wherein the share unit comprises a fifth controllable switch and a sixth controllable switch; a control end of the fifth controllable switch receives the first clock signal; a first end of the fifth controllable switch connects to a second end of the sixth controllable switch, the second end of the second controllable switch, a first end of the fourth controllable switch, and the output end of the current scanning signal; a second end of the fifth controllable switch receives the first voltage signal; a control end of the sixth controllable switch receives the second clock signal; a first end of the sixth controllable switch receives the second voltage signal.

4. The scanning driving circuit having charge sharing according to claim 3, wherein the first, the second, the third, the fourth, the fifth, and the sixth controllable switch are N-type thin film transistors (TFTs); a gate, a drain, and a source of the N-type TFT respectively corresponds to the control end, the first end, and the second end of the first, the second, the third, the fourth, the fifth, and the sixth controllable switch.

5. The scanning driving circuit having charge sharing according to claim 2, wherein the share unit comprises a fifth controllable switch, a sixth controllable switch, a seventh controllable switch, an eighth controllable switch, a ninth controllable switch, and a tenth controllable switch; wherein a control end of the fifth controllable switch connects a control end of the eighth controllable switch, the first end of the second controllable switch, and an output end of the current scanning signal; a first end of the fifth controllable switch receives the first clock signal; a second end of the fifth controllable switch connects to a control end of the sixth controllable switch and a first end of the seventh controllable switch; a first end of the sixth controllable switch receives the second voltage signal; a second end of the sixth controllable switch connects to a first end of the ninth controllable switch and the output end of the current scanning signal; a control end of the seventh controllable switch receives the next scanning signal; a second end of the seventh controllable switch is grounded; a first end of the eighth controllable switch receives the second clock signal; a second end of the eighth controllable switch connects to a control end of the ninth controllable switch and a first end of the tenth controllable switch; a second end of the ninth controllable switch receives the first voltage signal; a control end of the tenth controllable switch receives a previous clock signal, and a second end of the tenth controllable switch is grounded.

6. The scanning driving circuit having charge sharing according to claim 5, wherein the first, the second, the third, the fourth, the fifth, the sixth, the seventh, the eighth, the ninth, and the tenth controllable switch are N-type TFTs; a gate, a drain, and a source of the N-type TFT respectively corresponds to the control end, the first end, and the second end of the first, the second, the third, the fourth, the fifth, the sixth, the seventh, the eighth, the ninth, and the tenth controllable switch.

7. A display panel comprises a scanning driving circuit having charge sharing, the scanning driving circuit comprising:

a driving unit configured to receive a previous scanning signal Gn−1, a current clock signal Ckn, and a next scanning signal Gn+1, and to generate a current scanning single Gn according to the previous scanning signal, the current clock signal and the next scanning signal, wherein n is an integer;

a pull-down maintain unit connecting to the driving unit and configured to conduct a pull down process with respect to a pull down controlling signal point of the driving unit;

a share unit connecting to the driving unit and the pull-down maintain unit, wherein the share unit is configured to receive a first clock signal, a second clock signal, a first voltage signal, and a second voltage signal, and to control an electric potential of a rising edge and a falling edge of the current scanning signal via the first clock signal, the second clock signal, the first voltage signal, and the second voltage signal, so as to reduce a scanning-driving-circuit compensation voltage.

8. The display panel according to claim 7, wherein the driving unit comprises:

a first controllable switch, a second controllable switch, a third controllable switch, a fourth controllable switch, and a capacitance; a control end of the first controllable switch connects to a first end of the first controllable switch and receives the previous scanning signal, a second end of the first controllable switch connects to the pull-down maintain unit, a control controllable switch of the second controllable switch, and a first end of the third controllable switch; a first end of the second controllable switch receives the current clock signal; a second end of the second controllable switch connects to a first end of a fourth controllable switch, the pull-down maintain unit, the share unit, and an output end of the current scanning signal; a control end of the fourth controllable switch connects to a control end of the third controllable switch and is configured to receive the next scanning signal; a second end of the fourth controllable switch connects to a second end of the third controllable switch, the pull-down maintain unit, and the second end of the fourth controllable switch is grounded; the capacitance connects between the control end and the second end of the second controllable switch.

9. The display panel according to claim 8, wherein the share unit comprises a fifth controllable switch and a sixth controllable switch; a control end of the fifth controllable switch receives the first clock signal; a first end of the fifth controllable switch connects to a second end of the sixth controllable switch, the second end of the second controllable switch, a first end of the fourth controllable switch, and the output end of the current scanning signal; a second end of the fifth controllable switch receives the first voltage signal; a control end of the sixth controllable switch receives the second clock signal; a first end of the sixth controllable switch receives the second voltage signal.

10. The display panel according to claim 9, wherein the first, the second, the third, the fourth, the fifth, and the sixth controllable switch are N-type TFTs; a gate, a drain, and a source of the N-type TFT respectively corresponds to the control end, the first end, and the second end of the first, the second, the third, the fourth, the fifth, and the sixth controllable switch.

11. The display panel according to claim 8, wherein the share unit comprises a fifth controllable switch, a sixth controllable switch, a seventh controllable switch, an eighth controllable switch, a ninth controllable switch, and a tenth controllable switch; wherein a control end of the fifth controllable switch connects a control end of the eighth controllable switch, the first end of the second controllable switch, and an output end of the current scanning signal; a first end of the fifth controllable switch receives the first clock signal; a second end of the fifth controllable switch connects to a control end of the sixth controllable switch and a first end of the seventh controllable switch; a first end of the sixth controllable switch receives the second voltage signal; a second end of the sixth controllable switch connects to a first end of the ninth controllable switch and the output end of the current scanning signal; a control end of the seventh controllable switch receives the next scanning signal; a second end of the seventh controllable switch is grounded; a first end of the eighth controllable switch receives the second clock signal; a second end of the eighth controllable switch connects to a control end of the ninth controllable switch and a first end of the tenth controllable switch; a second end of the ninth controllable switch receives the first voltage signal; a control end of the tenth controllable switch receives a previous clock signal, and a second end of the tenth controllable switch is grounded.

12. The display panel according to claim 11, wherein the first, the second, the third, the fourth, the fifth, the sixth, the seventh, the eighth, the ninth, and the tenth controllable switch are N-type TFTs; a gate, a drain, and a source of the N-type TFT respectively corresponds to the control end, the first end, and the second end of the first, the second, the third, the fourth, the fifth, the sixth, the seventh, the eighth, the ninth, and the tenth controllable switch.

* * * * *